United States Patent [19]

Trotta

[11] 4,198,084

[45] Apr. 15, 1980

[54] SAFETY DOOR LOCK

[75] Inventor: Frank A. Trotta, New York, N.Y.

[73] Assignee: General Safety Corporation, Greenwich, Conn.

[21] Appl. No.: 958,509

[22] Filed: Nov. 7, 1978

[51] Int. Cl.[2] ..... E05C 3/04

[52] U.S. Cl. ..... 292/209; 292/DIG. 63

[58] Field of Search ..... 292/DIG. 63, 209, 210, 292/216, 78

[56] References Cited

U.S. PATENT DOCUMENTS

| | | | |
|---|---|---|---|
| 758,416 | 4/1904 | Clapp | 292/209 X |
| 1,088,526 | 2/1914 | Brae | 292/209 |
| 1,346,566 | 7/1920 | Stamm | 292/DIG. 63 |
| 2,479,626 | 8/1949 | Klein | 292/78 X |
| 3,507,531 | 4/1970 | Smith | 292/209 X |
| 3,999,792 | 12/1976 | Smith | 292/DIG. 63 |

FOREIGN PATENT DOCUMENTS

| | | | |
|---|---|---|---|
| 17160 | 4/1913 | Denmark | 292/209 |

*Primary Examiner*—Richard E. Moore

*Attorney, Agent, or Firm*—Morgan, Finnegan, Pine et al

[57] ABSTRACT

A composite safety lock for a door which lock has a passage long enough to prevent access to the actuation mechanism by a child but not by an adult.

12 Claims, 8 Drawing Figures

Fig. 1.
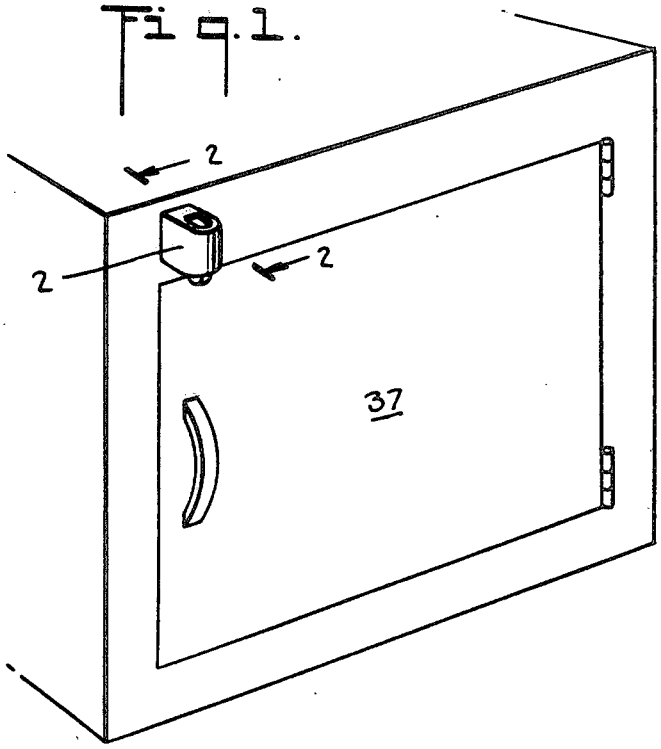
Fig. 2.
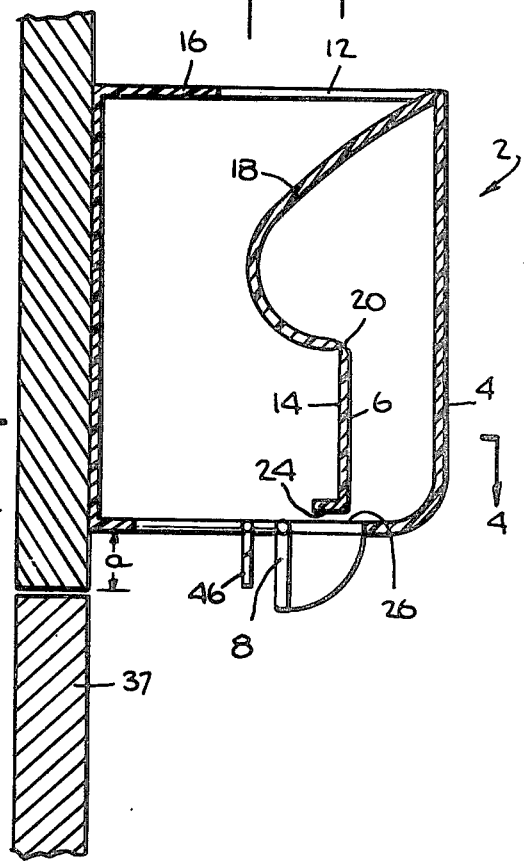
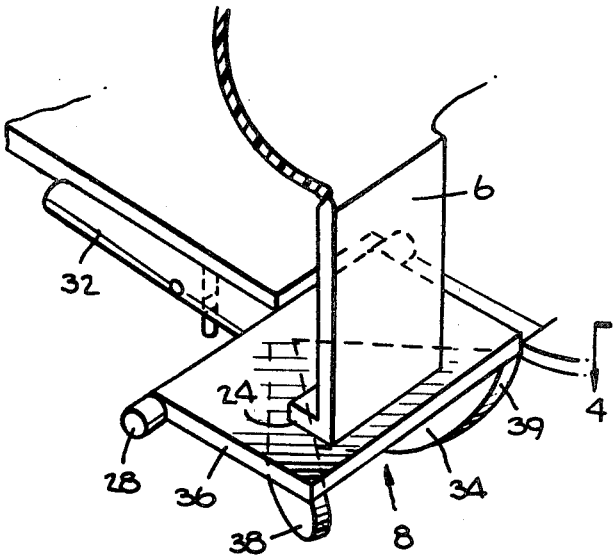
Fig. 3.

SAFETY DOOR LOCK

BACKGROUND OF THE INVENTION

1. Field of the Invention

This application relates to a safety device for preventing infants and young children from using potentially dangerous articles. In particular, this invention is directed to a safety device for preventing infants and young children from opening various doors in which potentially dangerous articles are kept.

2. Description of the Prior Art

In recent years there has been developed a dramatic concern for preventing children from gaining access to dangerous articles such as pesticides, adult medication, matches, etc.

Thus, many efforts have been made to design and develop devices that will prevent children from gaining access to potentially dangerous products. One effort can be characterized as the intellectually oriented solution. Essentially, the intellectually oriented solution provides locking devices which allegedly can only be understood by adults. The fallacy in these devices resides in the fact that some children are intellectually more advanced than some adults. In addition, the intellectually oriented solutions stimulate the inquisitive nature of children and encourage rather than discourage a child's interest in a potentially dangerous product container.

Another attempt at solving the problem is a snap-on safety cap which is essentially a device that relies on a force fit with a container. Theoretically, the cap can only be removed by the exertion of a relatively strong force.

Various other closure type devices have been advanced to solve the problem. In this category are the closures which require an alignment of parts fixed in a particular registry to afford separation, the press and release cap and the mechanical release type. In operation, the press and release cap requires that pressure to be applied at the top or sides to remove the cap. The mechanical release closures requires the introduction of a separate removal part such as a ratchet or key piece which becomes part of the cap.

The prior art also contains devices provided with a passage to afford access by an adult to the article or opening mechanism but prevent access thereof by a child. Previously, structures for actuating match boxes (Berry, U.S. Pat. No. 1,828,698) and switch structures (Van Hook, U.S. Pat. No. 3,109,900) have employed access passages for fingers. Further, passages sized to exclude a child's finger have been disclosed in aerosol can caps (Trotta, U.S. Pat. No. 3,876,113; Trotta, U.S. Pat. No. 3,958,726; Corll, U.S. Pat. No. 3,712,515) and other dispensers (Trotta, U.S. Pat. No. 3,698,543; Corll, U.S. Pat. No. 3,554,366).

SUMMARY OF THE INVENTION

The invention of the subject application is comprised of a composite locking unit consisting essentially of a chamber accommodating an actuator lock member and a hinged stop member which cooperates with the actuator lock member to interfere with the movement of a door and thereby maintain the door in a locked position. The actuator lock member is mounted on a hinge for pivotal movement and is provided with a surface against which an adult's finger can press to move the actuator lock member about the hinge and away from the stop. The surface for the adult's finger is located a distance away from an opening in the container such that an adult's finger can reach the surface but a child's finger is too short to reach the surface. The hinged stop member is provided with essentially three surfaces which form a three arm bellcrank. One surface or arm of the stop abuts the door to be locked when the actuator member is in the locked position, another surface provides the bearing surface against which the actuator lock member bears to react any force transmitted by the door to the stop member and the third surface provides a lever adapted to automatically return the stop member to the lock position when the door is closed.

DESCRIPTION OF THE DRAWINGS

FIG. 1 is a perspective view of the safety door lock of the subject invention mounted adjacent a door;

FIG. 2 is a sectional elevational view through lines 2—2 of FIG. 1;

FIG. 3 is a partial enlarged isometric view of the actuator and bellcrank of the safety door lock in the locked position;

DESCRIPTION OF THE PREFERRED EMBODIMENT

Figure 5:
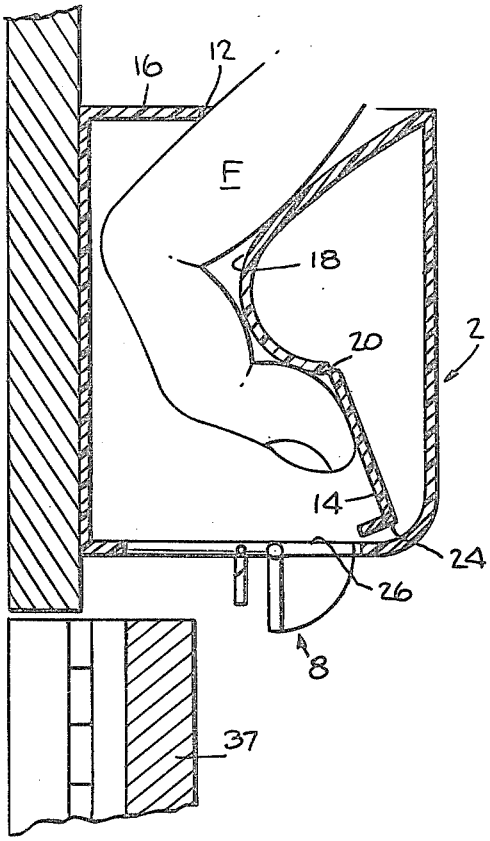
FIG. 5 is a sectional elevational view as in FIG. 2 showing the actuator member rotated to enable the bellcrank to pivot to the open position.

The safety door lock 2 of the present invention is a composite assembly adapted to be mounted on a fixed surface adjacent an edge of a door. In practice it is anticipated that the safety lock will have principle utility in use with medicine cabinet doors, kitchen cabinets and any other cabinet containing tools or potentially poisonous articles such as pesticides, or detergents.

The composite safety door lock 2, as seen in FIGS. 1 and 2, comprises a housing 4, an actuator lock member 6 located within the housing member 4 and a stop member 8 hingedly mounted to the housing 4.

The housing 4 is sized to provide a passage which will enable access to operate the lock by the finger F of an adult. However, the housing 4 is sized to insure that the bearing surface 14, i.e., the surface on which the application of force to move the actuator lock member 6 is located, is a sufficient distance from the opening 12 in the housing to prevent access to the pressure surface 14 by the finger of a child. The upper surface 16 of the housing 4 is a complete cover except for the opening 12 through which the adult's finger F can pass. The housing is also provided with a floor or ramp 18 which extends in an arcuate path into the area below the finger opening 12. The presence of the arcuate ramp 18, cover 16 and off-center location of the opening 12 cooperate to prevent access to the pressure surface 14 by a rigid object such as a pencil or a utensil.

The actuator lock member 6 is fixed to the interior of the housing 4 by a hinge 20 and is biased either inherently or by a spring into the locked position best seen in FIG. 2. Practice has shown that the hinge and spring function can be performed by a molded hinge having inherent spring biasing capacity. The actuator lock member 6 is provided with a lower surface 24 and is sufficiently rigid to withstand and react any force imposed thereon by rotation of the stop member 8 against the actuator lock member 6. The lower surface 24 of the actuator lock member 6 bears against a surface 26 of the stop member 8 to insure that the stop member 8 will be retained in a fixed lock position when the surface 24 abuts the stop member 8.

In practice it has been found that the surface 24 should be configured to conform to the surface of the stop member 8 against which it will bear; e.g. an essentially flat surface 24 is preferred.

The actuator lock member 6 is also provided with a surface 14 against which an adult's finger is designed to bear and thereby rotate the entire actuator lock 6 about hinge 20 in opposition to the inherent spring force of the hinge 20. As best seen in FIG. 5, rotation of the actuator lock 6 by the finger F of an adult bearing against surface 14 displaces the actuator lock 6 and in particular surface 24 from the path of the stop member 8.

The stop member 8 is mounted to the housing 4 by a hinge 28. The housing 4 is provided with an opening 30 best seen in FIG. 6, through which a portion of the stop member 8 can travel when the actuator lock member 6 is displaced from the area of the opening 30.

Figure 6:
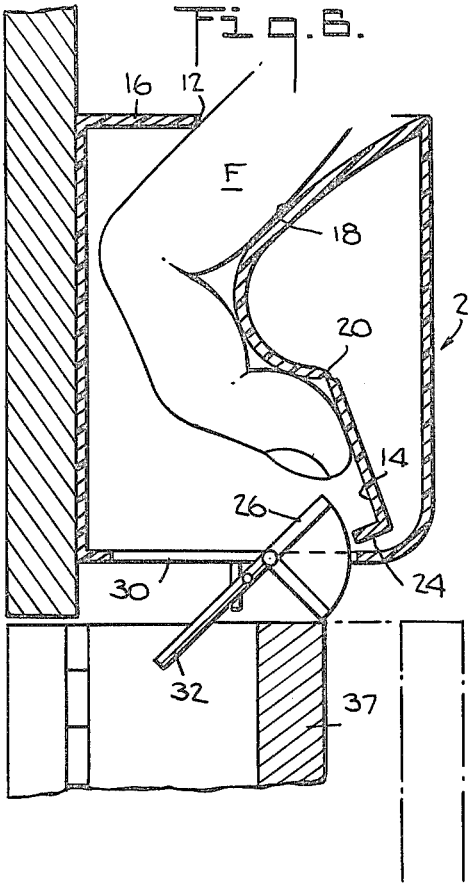
FIG. 6 is a sectional elevational view of the safety lock mechanism as in FIGS. 2 and 5 with the bellcrank pivoted to the open position.
Figure 4:
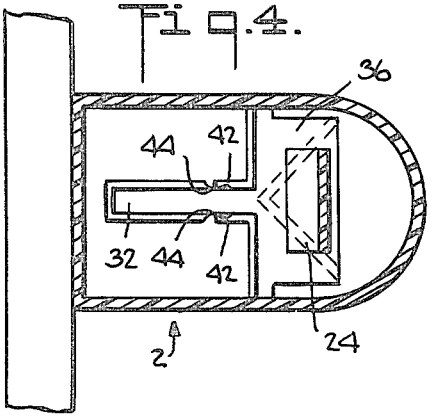
FIG. 4 is a plane view through line 4—4 of FIG. 2.
Figure 7:
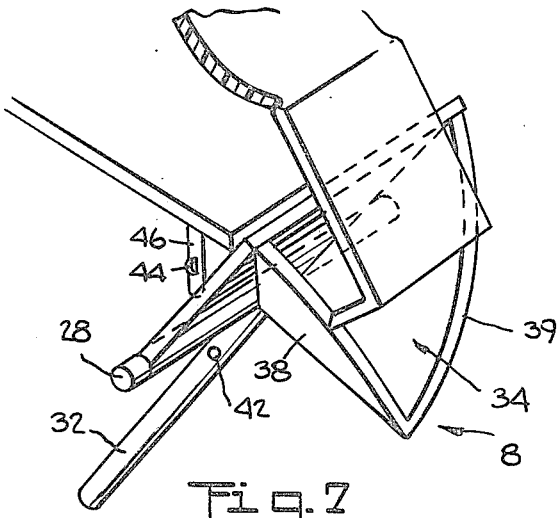
FIG. 7 is a partial enlarged isometric view of the actuator and bellcrank in the open or unlocked position.

The stop member 8, best seen in FIGS. 3, 4 and 7, is provided with three surfaces or arms 32, 34, and 36 respectively which, in effect, form a three arm bellcrank. Surface or arm 36 is located essentially in the opening 30 of the housing 4 and when the lock 2 is in the locked position surface 24 of the actuator lock 6 bears directly against the surface 36 of the stop member 8 to rigidly fix the stop member 8 in the locked position. The surface 34 provides the actual surface against which the door 37 abuts to foreclose opening of the door 37. Any force transmitted by the door 37 to the surface 34 is reacted around the hinge 28 to the surface 26 of the actuator lock member 6 and ultimately to the housing 4. The surface 32 functions as a return lever 32 to restore the stop member 8 to the locked position. As best seen in FIG. 6, the surface 32 is directly in the path of the door 37 when the door 37 is being returned to the closed position. Therefore, the door 37 will engage surface 32 and thereby rotate the entire stop member 8 to the locked position as the door 37 is closed. The arm 34, in the preferred embodiment is provided with contoured surfaces 38 and 39 which sweep back from the vertical depending portion of arm 34. The contour for the ribs 38 provide structural support and an outwardly extending arc which prevents the spring loaded actuator lock 6 from returnign to the locked position before the stop member 8 by preventing further clockwise rotation of the stop member 8 about hinge 28 due to the inherent spring force imposed on the actuator lock 6 or from hooking the actuator lock 6 under the arm on which the surface 36 is formed.

The arm 32 of the bellcrank 8 is also provided with protuberances 42. The protuberances 42 are arranged to coooperate with protuberances 44 on posts 46 which depend downwardly adjacent the opening 30. The protuberances 42 on the arm 32 are forced over the protuberances 44 on the posts 46 as the bellcrank 8 is rotated about hinge 28 by the door 37. After the protuberances 42 are forces over the protuberances 44 the protuberances 44 maintain the bellcrank 8 in the open orientation as seen in FIG. 6. When the door is returned to the closed position, a sufficient force is provided to force the protuberances 42 back over the protuberances 44 to receive the bellcrank 8 in the locked position.

Figure 8:
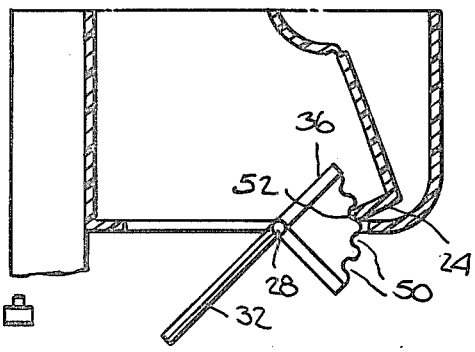
FIG. 8 is an alternative embodiment of the bellcrank of the safety lock.

An alternative embodiment is seen in FIG. 8 wherein the contoured surfaces 38 and 39 of arm 34 are provided with notches 50 which cooperate with the leading edge 52 of the actuator lock surface 34 to retain the bellcrank in the open position.

An allowance a is provided between the top of the door 37 and the lock 2 to prevent jamming of the door 37 between arms 32 and 34 as the door 37 travels between the locked and unlocked positions. Practice has taught that the allowance a should be $\frac{1}{4}$ to 1 inch when the door 37 is $\frac{1}{2}$ inch thick.

In practice it has also been found that an opening 12 of approximately 1 inch to $2\frac{1}{4}$ inches in the roof or cover 16 of the housing 4 is suitable and a ramp 18 extending 1 inch to 2 inches under the area of the opening 12 is preferable. Practice has also taught that the upper edge of the bearing surface 14, i.e. the hinge 20, should be 1 inch to 2 inches from the opening 12. The dimensions in combination with the acruate ramp 18 insure that a child's finger cannot reach the pressure surface on the actuator lock member 6.

In operation, the safety lock member 2 functions to maintain a door 37 in the closed position by the normal at rest orientation of the lock mechanism. The actuator 6 is biased counterclockwise into the position wherein surface 24 is in registry with the opening 30 in the bottom of the housing 4. The surface 36 of the stop member 8 is also in registry with the opening 30 and bears directly against the surface 24 of the actuator 6. Thus, the stop surface 34 abuts the door 37 and prevents any movement of the door 37. The force exerted by the door 37 being urged into the open position bears directly against surface 34 and is transmitted around hinge 28 directly to the surface 24 of the actuator lock 6 and ultimately to the housing 4. As best seen in FIGS. 5 and 6, when an adult's finger F is passed through the opening 12 to bear against the actuator surface 14, the force of the finger F rotates the actuator 6 clockwise around hinge 20 overcoming the inherent spring force and displaces the surface 24 from the opening 30 in the bottom of the hosuing 4. Therefore, the stop member 8 is free to pivot about hinge 28 through the opening 30 into the housing 4 in response to a force imposed on stop surface 34 by the door 37.

The mechanism is essentially self-seating as can be seen in FIGS. 6 and 7. The actuator lock 6 upon being freed of the forced imposed by an adult's finger will be urged to return counterclockwise to the locked position by spring 22. However, the contoured ribs 38 and 39 forming the stop member 34 interfere with the return of the actuator lock 6 to the fully closed position until the door 37 is returned toward the closed position. Upon return of the door 37 to the closed position, the door 37 will bear against the surface 32 and rotate the stop member 8 around the hinge 28 into alignment with the opening 30 in the bottom of the housing 4. The actuator lock 6 then is free to continue travel toward the locked position in response to the inherent spring force imposed by the living hinge 20. Thus, the assembly is returned to the locked position shown in FIG. 2.

The door lock 2 is both a safety and a composite locking mechanism requiring the cooperation of no parts independent of the assembly. It should be noted that various orientations and arrangements of the actuator lock 6 with respect to the stop member 8 are contemplated in the design of the subject invention. For example, the actuator lock 6 can be arranged at a right angle to the stop member 8 to afford mounting configurations compatable with any door arrangement.

I claim:

1. A safety lock for a door comprised of:

a housing member;

a hingedly mounted actuator lock fully contained within the housing adapted for movement between a locked and unlocked position;

a pressure surface on the actuator lock member against which an adult's finger can bear to rotate the actuating lock member about the hinge;

an opening in the housing sufficiently remote from the pressure surface on the actuator lock member to afford access to the pressure surface by an adult's finger but not a child's finger; and a stop member rotatably mounted on the housing having a first reaction surface in registry with a surface of the actuator lock member when the actuator lock member is in the locked position and a second stop surface essentially normal to the first surface which second surface of the stop member is aligned with the path of travel of the door to be locked.

2. A safety lock for a door as in claim 1 further comprising a third return surface on the stop member extending beyond the housing mount to the side opposite of the first reaction surface and arranged essentially normal to the second stop surface of the stop member to provide a surface against which a door being closed operates to rotate the stop member from the open to closed position.

3. A safety lock as in claim 2 for a door further comprising an upper cover having a hole therein and an arcuate ramp member extending into the area beneath the hole.

4. A safety lock for a door as in claim 3 wherein the stop mechanism is hinged to the housing adjacent a hole in the bottom of the housing sized essentially to the size of the first reaction surface of the stop member and whereby a reaction surface on the actuator lock is in registry with the opening in the bottom of the housing when the actuator lock has been urged to the locked position.

5. A safety lock for a door as in claim 4 further comprising a three arm bellcrank, the arms of which have respectively the first reaction stop surface, the second stop surface and the third return surface;

ribs on the lock member between the arms which carry the first reaction surface and the second stop surface of the stop member.

6. A safety lock for a door as in claim 4 wherein the first reaction surface of the stop member and the reaction surface on the actuator lock are essentially flat.

7. A safety lock for a door as in claim 1 further comprising a spring to bias the actuator lock member into the locked position.

8. A safety lock for a door as in claim 7 wherein the actuator lock spring and hinge are formed of a single inherently spring-biased hinge.

9. A safety lock as in claim 1 arranged above a door to be closed wherein the distance from the bottom of the safety lock to the top of the door is an allowance area of $\frac{1}{4}$ inch to 1 inch when the door is $\frac{1}{2}$ inch thick.

10. A safety lock as in claim 5 further comprising contoured swept back surfaces constituting the arm of the three arm bell-crank arranged to provide the stop surface; and means for preventing the bellcrank to return to the closed position until provided with an external force.

11. A safety lock for a door as in claim 10 wherein the means for preventing the bellcrank from returning to the closed position are protuberances on the return surface and protuberances on a depending protuberances which respective protuberances are in alignment.

12. A safety lock for a door as in claim 10 wherein the means for preventing the bellcrank from returning to the locked position are notches in the contoured members of the stop surface arranged to cooperate with the leading edge of the lower surface of the actuator lock member.

* * * * *